United States Patent [19]

Fritzsche et al.

[11] 4,371,303

[45] Feb. 1, 1983

[54] RAILWAY CAR FABRICATION FACILITY

[75] Inventors: Eldred N. Fritzsche, Kirkwood; Edgar F. Josephson, St. Charles, both of Mo.; Frank C. Pulcrano, Huntington, W. Va.

[73] Assignee: ACF Industries, Incorporated, New York, N.Y.

[21] Appl. No.: 218,147

[22] Filed: Dec. 19, 1980

[51] Int. Cl.[3] ..... F65G 63/02

[52] U.S. Cl. ..... 414/281; 414/120; 29/430; 29/823

[58] Field of Search ..... 29/428–430, 29/822–824, 771, 791; 414/120, 266, 267, 281, 279

[56] References Cited

U.S. PATENT DOCUMENTS

| | | | |
|---|---|---|---|
| 2,118,448 | 5/1938 | Wallace et al. | 29/430 |
| 2,671,957 | 3/1954 | Sheffer et al. | 29/430 |
| 2,779,092 | 1/1957 | Gordon | 29/430 |
| 2,872,709 | 2/1959 | Brem | 29/823 |
| 3,583,584 | 6/1971 | Iacco | 414/279 |
| 3,718,803 | 2/1973 | Evans | 228/47 |
| 3,982,642 | 9/1976 | Muller | 414/281 |
| 4,136,789 | 1/1979 | Mulock Houwer | 414/266 |
| 4,257,158 | 3/1981 | Casutt et al. | 29/824 |

FOREIGN PATENT DOCUMENTS

| | | | |
|---|---|---|---|
| 52-14278 | 2/1977 | Japan | 29/429 |

*Primary Examiner*—Daniel C. Crane

*Attorney, Agent, or Firm*—Henry W. Cummings

[57] ABSTRACT

A railway car fabrication facility includes cranes for moving right and left hand railway car sides having a bulbous portion and a flat portion. One crane picks up the sides and places them vertically into a below ground transfer pit. A second crane picks up at least the left hand sides from the transfer pit and places them in a below ground storage pit located on an opposite side of a car assembly station. The second crane preferably includes right and left hand cranes for transferring both right and left hand sides into the assembly station to assemble the right and left hand sides with the under frame, bulkheads and/or the roof of the car.

12 Claims, 3 Drawing Figures

RAILWAY CAR FABRICATION FACILITY

BACKGROUND OF THE INVENTION

Railway hopper cars often are formed with curved sides and stub sills as illustrated for example in U.S. Pat. No. 3,339,499. The sides include lower longitudinal bulbous supports called side sills and upper longitudinal bulbous supports called top plates. Flat sides containing the side sills and side plates are forced against transverse bulkheads into a curved configuration by hydraulic cylinders and pistons, for example as described in U.S. Pat. No. 3,718,803.

In accordance with one construction, left hand sides contain a brake pipe which is inserted into the side sill. Otherwise right hand sides differ from like left hand sides only in that they are 180° mirror images of each other. Thus, absent the brake pipe, the sides could be rotated 180° to constitute either right hand or left hand sides.

However, rotating such heavy members when suspended from a crane is a dangerous operation. Once sufficient inertia is applied to a side to rotate it, it tends to continue rotating, and a stop is required to cease rotation. An impact between the rotating side and the stop may cause the side to disengage from the crane clamping fixture. Thus, for reasons of safety the assignee of the present application has decided not to rotate sides and to make right and left hand sides.

Previously because of height constrictions of the building and the crane structure, it was not possible to lift the right hand sides over the left hand sides and vice versa. Previously in order to move the right hand sides relative to the left hand sides, the sides to be moved were moved within the facility and often out of the facility on carts and then back into the facility at a point spaced from the sides to be transverse. The movement of these carts about the facility is an awkward operation requiring careful scheduling to avoid interference with other work.

SUMMARY OF THE INVENTION

The object of the present invention is to provide a production facility and a method of assembly of container sides which does not require rotation of the sides when suspended from an overhead crane and in which the building and crane structure need not be excessively high above the floor. Thus existing building structure may be used, or if a new facility is to be constructed, the cost of such a new facility will not be greatly increased because of additional height requirements.

A railway car fabrication facility includes means for supporting right hand and left hand railway car sides having a bulbous portion and a flat portion in a side assembled position. A first longitudinally movable crane means picks up the sides from the side assembled position and places them into a below ground transfer pit. A laterally second movable crane means picks up at least the left hand sides from the transfer pit and places them in a separate below ground storage pit located on an opposite side of a car assembly position. Preferably, the second laterally movable crane means includes right and left hand longitudinal cranes for transferring right and left hand sides into position to assemble the right and left hand sides with the underframe bulkheads and/or the roof of the car. Preferably, the first longitudinally movable crane means is wall mounted crane which moves the sides from the horizontal assembled position to a stored position in the transfer pit.

DESCRIPTION OF PREFERRED EMBODIMENTS

Figure 1:
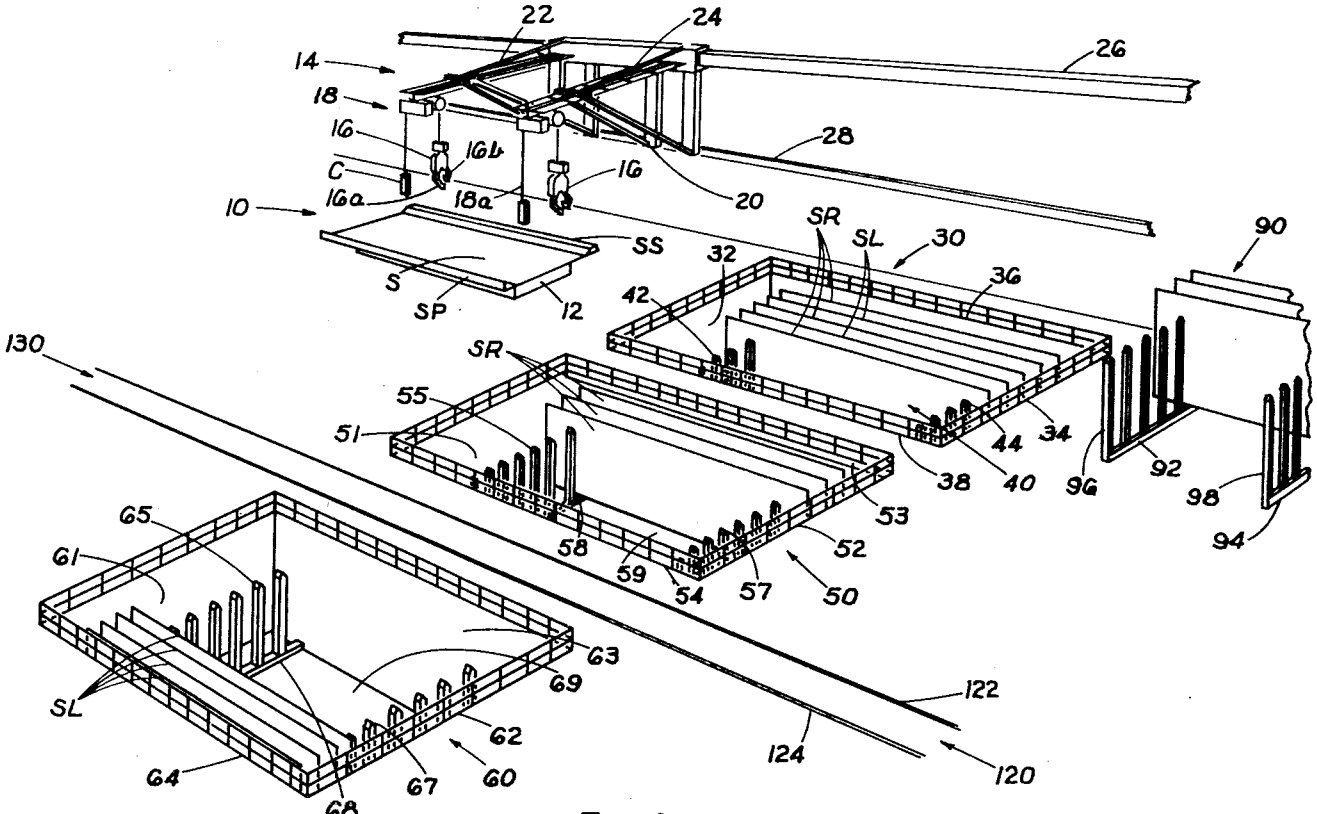
FIG. 1 is a perspective view of the first crane means used to move the sides longitudinally, and the below ground storage facilities of the present invention.
Figure 2:
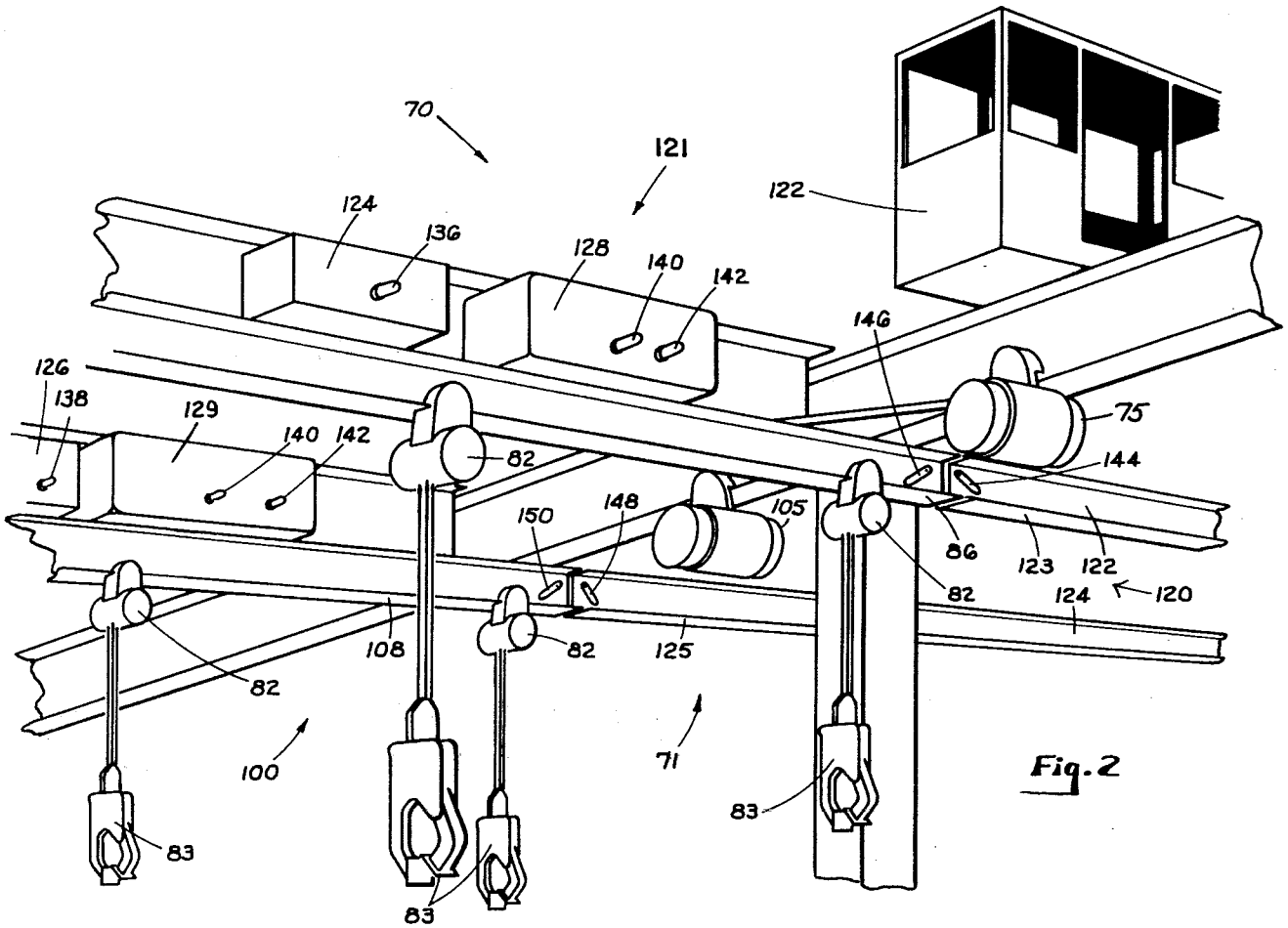
FIG. 2 is a perspective view of the second crane means of the present crane means of the present invention with the second crane means aligned with a track for moving the sides longitudinally to a rail car assembly position.

In accordance with the present invention, railway car sides S, having a side sill SS and a side plate SP are located after assembly at a first station 10. At the station 10 the sides S are supported horizontally by means of a support table 12 for inspection and repair. A wall crane 14 of conventional construction but including a pair of depending clamps 16 depending from hoists 18 preferably constructed according to the teachings of application Ser. No. 206,418 filed 11-13-80 are used to pick up the sides S from the horizontal position to a vertical position. Reference may be made to application Ser. No. 206,418 filed 11-13-80 for detailed description of the operation of clamps 16. Each of the hoists are movable upon beams 22 and 24 supported by diagonals 20. In addition, the entire crane 14 is movable longitudinally along longitudinal tracks 26 and 28.

Briefly the clamps 16 include fixed arms **16*a*, and movable arms 16*b*. A motor (not shown) is used to move the movable arms 16*b* between open and closed positions relative to a bulbous portion such as the side sill SS or the side plate SP of the side S. Movement of the movable arms 16*b* can be controlled by buttons on the clamps or by a depending crane control 18*a*** of known construction.

After the sides are lifted by the hoists 18 they are moved longitudinally by the wall crane 14 to a transfer pit 30. The transfer pit 30 is a below ground storage facility and includes end walls 32, 34 and side walls 36 and 38, which define a rectangular open space 40. Within the space 40 are a plurality of side supports 42 and 44. The sides S are lowered into the transfer pit 30 by the hoists 18 and rest upon the ground floor. Supports 42 and 44 then support the sides within the transfer pit.

The sides S are right hand sides (SR) and left hand sides (SL). Left hand sides contain a brake pipe which is inserted into the side sill. Otherwise right hand sides differ from like left hand sides only in that they are 180° mirror images of each other. Thus, absent the brake pipe, the sides could be rotated 180° to constitute either right hand or left hand sides.

However rotating such heavy members when suspended from a crane is a very dangerous operation. Once sufficient inertia is applied to a side to rotate it, it tends to continue rotating, and a stop means is required to stop side from rotating. The impact of the side with the stop means could jar the side loose from its clamps. Thus for reasons of safety the assignee of the present application has decided not to rotate sides and make right and left hand sides.

Previously because of height constrictions of the building and the crane structure it was not possible to lift the right hand sides over the left hand sides and vice versa. As mentioned in the Background Of The Invention, previously in order to move the right hand sides relative to the left hand sides, the sides to be moved were moved within the facility and often out of the facility on carts and then back into the facility at a point spaced from the sides to be transversed. The movement of these carts about the facility is an awkward operation requiring careful scheduling to avoid interference with the other work. Thus storing of the sides in the below ground storage facilities described in this application overcomes all or many of the foregoing problems.

Both left hand and right hand sides are placed within the storage pit 30. From the storage pit 30 right hand sides (SR) are preferably moved to a right hand storage pit 50 constructed similarly to below ground storage pit 30. Left hand sides are moved to a left hand storage pit 60, also constructed in a similar manner to transfer pit 30.

Right hand storage pit 50 includes end walls 51 and 52 and side walls 53 and 54. It also includes side supports 55 and 57 each of which are supported by a base 58 located on the floor 59 of the storage pit.

Left hand storage pit 60 includes end walls 61 and 62 and side walls 63 and 64. Storage pit 60 also includes side supports 65 and 67 each of which are supported by a base 68 located on the floor 69 of the storage pit.

An optional above ground storage area 90 may be provided. Storage area 90 includes support beams 92 and 94 each of which support vertical support members 96 and 98 to hold the sides in place. The above ground storage facility 90 is only utilized when the number of sides assembled exceeds the capacity of the transfer pit 30. If the transfer pit 30 is full, the wall crane 14 places the sides within the storage facility 90. Then when space is available within the transfer pit, the sides are moved from the storage facility 90 into the transfer pit 30 or into the appropriate right hand storage facility 50 or left hand storage facility 60.

Figure 3:
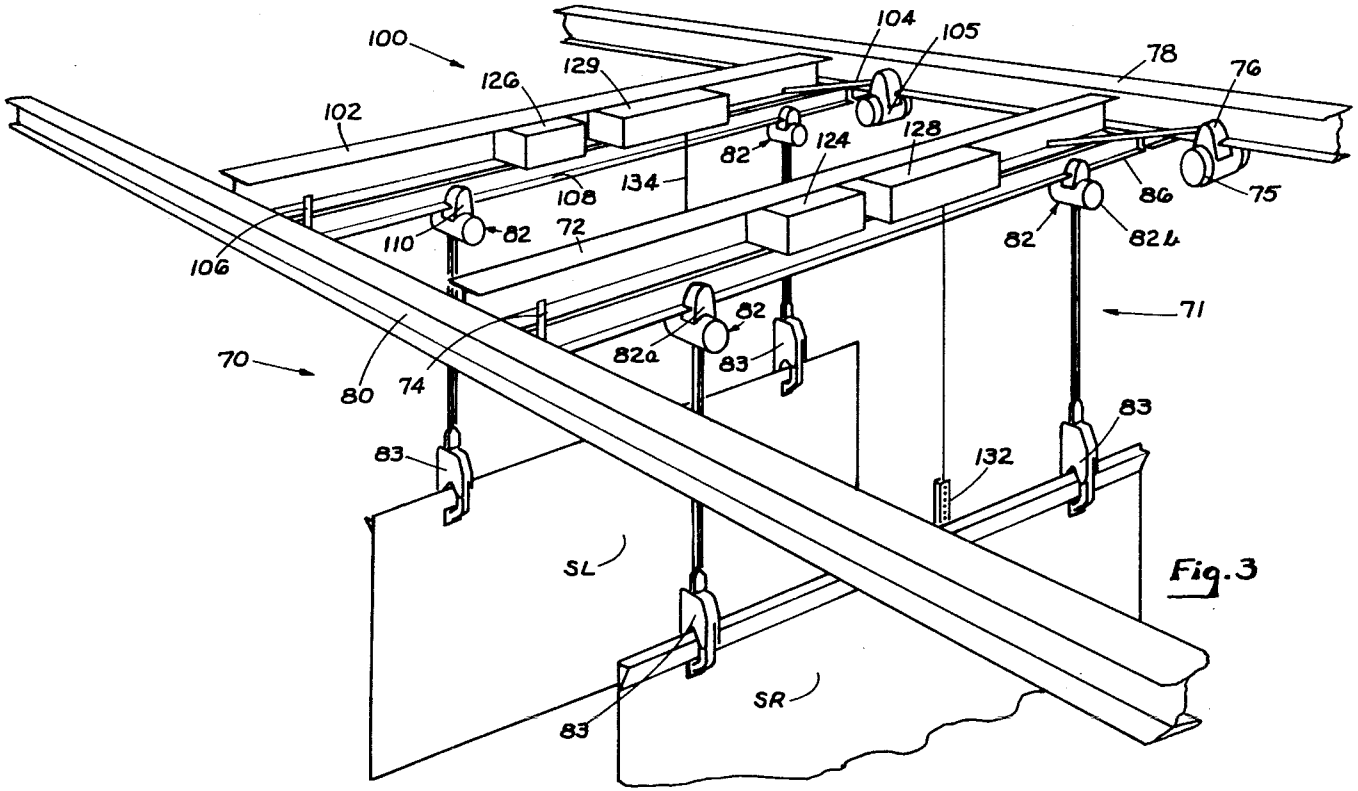
FIG. 3 is a perspective view of the second crane means located upon a laterally extending track for moving railway car sides into the below ground storage facilities of the present invention.

An overhead crane 70 includes a first crane assembly 71. A beam 72 having roller assemblies at each end respectively 74 and 76 (each having motors 75) is movable laterally upon tracks 78 and 80. See FIG. 3. In addition, hoists 82 having depending clamps 83 constructed in the same manner as clamps 16 described above and in application Ser. No. 206,408, are movable by means of respective rollers **82*a* upon a longitudinally extending horizontal track 86 provided on the lower portion of beam 72. Suitable motors 82*b* are provided to control the movement of clamps 82 in their longitudinal movement along track 86**.

Tracks 78 and 80 support a second laterally movable crane assembly 100. Assembly 100 is constructed in the same manner as assembly 71 including a beam 102, roller assemblies at either end 104 and 106 having motors 105, and a lower guide track 108 to receive rollers 110 from the cranes 82.

It is thus apparent that the left hand sides can easily be picked up for example by the crane assembly 100 through the use of clamps 83 and lifted from the transfer pit 30 into the left staging pit 60.

Similarly if desired, the right hand sides can be lifted from the storage transfer pit 30 and placed in the right hand staging pit 50 for example by the crane assembly 71.

In addition to moving sides from the transfer pit 30 to the right and left storage pits 50 and 60, the crane assemblies 71 and 100 are used to move the sides longitudinally along a longitudinal track 120 including a right track member 122 and a left track member 124. Tracks 122 and 124 have horizontal flanges 123 and 125 which are at the same height as horizontal flanges 86 and 108 of the respective cranes 71 and 100. Therefore, crane assemblies 71 and 100 can be aligned laterally such that cranes 82 can move first along flange portions 86 and 108 of respective crane assemblies 71 and 100 and then along tracks 122 and 124 to move the sides respective longitudinally to a station 130 (FIG. 1) where they are assembled against transverse bulkheads and the car underframe and are welded thereto, for example, according to the teachings of U.S. Pat. No. 3,718,803, hereby incorporated into the present application by this reference.

Crane 70 and crane assemblies 71 and 100 and clamps 83 may be controlled by a control system 121, or an attendant located in an overhead control station 122. The control system further includes a radio control box 124 and 126 respectively for each crane assembly 71 and 100, which are controlled from the operators station 122. Each crane assembly 71, 100 further includes second controls 128, 129 which include depending control members 132, 134 (FIG. 3) which can be controlled by an attendant on the ground. Controls 132 and 134 allow control of crane assemblies 71 and 100 separately, or simulataneously for example, when moving the sides together toward station 130. In this regard controls 124 and 126 contain lights 136 and 138 which light when control is operated from the operators station 122. Controls 128 and 129 contain a pair of lights. Light 140 lights when crane beams 86 and 108 align with spur tracks 122 and 124. Light 142 lights when crane interlocks are energized and the crane is locked to the spur track (122,124).

It therefore is apparent that left hand sides SL for example from storage pit 60 and right hand sides from storage pit 50 or transfer pit 30 can first be lifted vertically by means of and depending clamps 83, then moved laterally until they align respectively with tracks 124 and 122. Upon such alignment, saftey arms 144, 146, 148 and 150 pivot approximately 90° to allow movement of side assemblies respectively onto spur tracks 122 and 124. The sides may then be moved separately or simultaneously to the station 130. The below ground storage facilities 30, 50 and 60 allow left hand sides to be moved over right hand sides without rotation of the sides suspended from a crane. It is not necessary to run carts carrying the sides outside of the building to effect movement of left hand sides relative to right hand sides. The below ground storage facilities may be easily found in existing facilities. If a new facility is to be constructed, it need not be so tall as to move left hand or right hand sides over the other . 9n

What is claimed is:

1. A railway car fabrication facility for transporting railway car sides within the facility to a railway car assembly position so that the sides can be assembled into rail cars without necessitating rotation of the railway car sides during transportation to the car assembly position comprising: means for supporting right hand and left hand railway car sides having a bulbous portion and a flat portion in an above ground side assembly position;

a below ground transfer area spaced from said side assembly position along a first path; a first below ground storage area for right hand sides spaced from said transfer area along a second path extending laterally from said first path; a second below ground storage area for left hand sides spaced from said first below ground storage area; first longitudinally movable crane means, movable along said first path, for picking up the sides from said side assembly position and placing them into said below ground transfer area; second laterally movable crane means movable along said second path for picking up at least the left hand sides from said below ground transfer area and placing them in said second below ground storage area located on an opposite side of a car assembly position wherein the sides are placed in operative position in a railcar.

2. A railway car fabrication facility according to claim 1 wherein said second crane means includes right and left hand logitudinal cranes for transferring right and left hand sides into position to assemble the right and left hand sides with the underframe bulkheads and/or the roof of the car.

3. A railway car fabrication facility according to claim 2 wherein the same second crane means used to move the sides laterally are used to move the right and left sides longitudinally.

4. A railway car fabrication facility according to claim 2 wherein the height of the facility is less than that required to move right hand sides over left hand sides.

5. A railway car fabrication facility for transporting railway car sides within the facility to a railway car assembly position so that the sides can be assembled into railcars without necessitating rotation of the railway car sides during trnasportation to the car assembly position comprising: means for supporting right hand and left hand railway car sides having a bulbous portion and a flat portion in an above ground side assembly position; a below ground transfer area longitudinally spaced from said side assembly position along a first path; a first below ground storage area for right hand sides laterally spaced from said below ground transfer area, along a second path extending laterally from said first path; a seond below ground storage area for left hand sides laterally spaced fom said below ground transfer area and longitudinally spaced from said first below ground transfer area and longitudinally spaced from said first below ground storage area along said second path; first longitudinally movable crane means for picking up the sides from said side assembly position and moving the sides along said first path and placing them into said below ground transfer area; ssecond laterally movalbe crane means for picking up at least the left hand sides from said trnsfer area and moving the sides along said second path and placing them in said second below ground storage area located on an opposite side of a car assembly position; a third path generally parallel with said first path including a first track; said second laterally movable crane means alignable with said first track whereby said second laterally movable crane means is movable on said first track along said third path to a car assembly position.

6. A railway car fabrication facility according to claim 2 including a pair of spaced beams mounted on a second track extending along said second path to receive a pair of movable crane supports.

7. A railway car fabrication facility acording to claim 6 wherein said second laterally movable crane means includes at least a pair of cranes movable upon each of said movable crane supports.

8. A railway car fabrication facility according to claim 6 wherein said crane supports are movable to an aligned position with a pair of fixed crane supports on said first track whereby said cranes may move from said movable crane supports to said fixed crane supports.

9. A railway car fabrication facility according to claim 8 wherein said fixed crane supports extend to said car assembly position.

10. A railway car fabrication facility according to claim 9 wherein manual control means are provided for each of said cranes.

11. A railway car fabrication facility according to claim 10 wherein control means for said cranes and said crane supports are located in an overhead work station.

12. A railway car fabrication facility according to claim 8 wherein indicating means are provided which indicate alignment between said fixed crane supports and said movable crane supports.

* * * * *

UNITED STATES PATENT AND TRADEMARK OFFICE

CERTIFICATE OF CORRECTION

PATENT NO. : 4,371,303

DATED : February 1, 1983

INVENTOR(S) : Eldred N. Fritzsche, Edgar F. Josephson, Frank C. Pulcrano

It is certified that error appears in the above-identified patent and that said Letters Patent is hereby corrected as shown below:

Column 1, line 37, "transverse" should be --traversed--.

Column 1, line 59, "A laterally second" should be --A second laterally--.

Column 3, line 51, "Ser. No. 206,408" should be --Ser. No. 206,418--.

Column 4, line 59, delete "9n".

Column 5, line 19, "logitudinal" should be --longitudinal--.

Column 6, line 7, "ssecond" should be --second--; and "movalbe" should be --movable--.

Column 6, line 9, "trnsfer" should be --transfer--.

Column 6, line 19, "2" should be --5--.

Signed and Sealed this

*Thirteenth* Day of *December 1983*

[SEAL]

*Attest:*

GERALD J. MOSSINGHOFF

*Attesting Officer*

*Commissioner of Patents and Trademarks*